US009447515B2

(12) United States Patent
Truong

(10) Patent No.: US 9,447,515 B2
(45) Date of Patent: Sep. 20, 2016

(54) CONTROL OF ELECTROMAGNETIC SIGNALS OF COINS THROUGH MULTI-PLY PLATING TECHNOLOGY

(75) Inventor: Hieu Cong Truong, Orleans (CA)

(73) Assignee: Royal Canadian Mint, Ottawa (CA)

( * ) Notice: Subject to any disclaimer, the term of this patent is extended or adjusted under 35 U.S.C. 154(b) by 0 days.

(21) Appl. No.: 13/464,239

(22) Filed: May 4, 2012

(65) Prior Publication Data

US 2012/0273361 A1 Nov. 1, 2012

Related U.S. Application Data

(62) Division of application No. 12/483,423, filed on Jun. 12, 2009, now abandoned.

(60) Provisional application No. 61/061,287, filed on Jun. 13, 2008.

(51) Int. Cl.

| | |
|---|---|
| ***C25D 5/12*** | (2006.01) |
| ***A44C 21/00*** | (2006.01) |
| ***G07D 5/08*** | (2006.01) |

(Continued)

(52) U.S. Cl.

CPC ..... *C25D 5/10* (2013.01); *A44C 21/00* (2013.01); *C25D 5/12* (2013.01); *C25D 5/14* (2013.01); *C25D 7/001* (2013.01); *C25D 7/005* (2013.01);

(Continued)

(58) Field of Classification Search

CPC ..... G07D 5/08; C25D 5/12; A44C 21/00
USPC ..... 205/181, 182
See application file for complete search history.

(56) References Cited

U.S. PATENT DOCUMENTS

| | | | |
|---|---|---|---|
| 1,397,785 | A | 11/1921 | Bose et al. |
| 2,428,033 | A | 9/1947 | Nachtman et al. |

(Continued)

FOREIGN PATENT DOCUMENTS

| | | |
|---|---|---|
| CA | 1105210 | 7/1981 |
| CA | 2137096 | 12/1994 |

(Continued)

OTHER PUBLICATIONS

F. A. Lowenheim, Electroplating, McGraw-Hill Book Company, New York, 1978, pp. 117-119.*

(Continued)

*Primary Examiner* — Nicholas A Smith
(74) *Attorney, Agent, or Firm* — Boyle Fredrickson, S.C.

(57) ABSTRACT

The present invention relates to novel metallic composites that are useful as coinage materials. These composites are produced through a multi-ply plating process and are designed to overcome difficulties associated with calibrating vending machines that can result in fraud. In one embodiment, the metallic composite comprises a steel core over which nickel and then a non-magnetic metal such as copper, brass or bronze is deposited as a layered pair. The magnetic and non-magnetic metals may also be applied in the reverse order, with the copper, brass or bronze applied directly over the steel and then covered by the nickel. The electromagnetic signature (EMS) of the composite is controlled by defining the thickness of the deposited metal layers. Advantageously, the invention overcomes problems associated when different coins are made from the same alloy and have similar sizes, and therefore cannot be distinguished by vending machines.

11 Claims, 6 Drawing Sheets

(51) Int. Cl.
*C25D 5/10* (2006.01)
*C25D 5/14* (2006.01)
*C25D 7/00* (2006.01)

(52) U.S. Cl.
CPC ..... *G07D 5/08* (2013.01); *Y10T 428/12493* (2015.01)

(56) References Cited

U.S. PATENT DOCUMENTS

| | | | | |
|---|---|---|---|---|
| 3,156,804 | A | 11/1964 | Springer et al. | |
| 3,350,180 | A | 10/1967 | Croll et al. | |
| 3,368,880 | A | 2/1968 | Turillon | |
| 3,407,050 | A | 10/1968 | Trapp et al. | |
| 3,634,890 | A | 1/1972 | Zoebe et al. | |
| 3,697,237 | A | 10/1972 | Seiz | |
| 3,716,462 | A | 2/1973 | Jensen | |
| 3,750,253 | A | 8/1973 | Miller et al. | |
| 3,753,669 | A | 8/1973 | Churchill et al. | |
| 3,940,254 | A | 2/1976 | McMullen et al. | |
| 4,089,753 | A | 5/1978 | McMullen et al. | |
| 4,247,374 | A | 1/1981 | Ruscoe et al. | |
| 4,279,968 | A | 7/1981 | Ruscoe et al. | |
| 4,292,377 | A | 9/1981 | Petersen et al. | |
| 4,330,599 | A | 5/1982 | Winter et al. | |
| 4,353,453 | A | 10/1982 | Partin et al. | |
| 4,401,488 | A | 8/1983 | Prinz et al. | |
| 4,418,125 | A | 11/1983 | Henricks | |
| 4,436,790 | A | 3/1984 | Prinz et al. | |
| 4,551,184 | A | 11/1985 | Bell et al. | |
| 4,599,279 | A | 7/1986 | Mirra et al. | |
| 4,620,661 | A | 11/1986 | Slatterly | |
| 4,644,674 | A | 2/1987 | Burrows et al. | |
| 4,666,796 | A | 5/1987 | Levine | |
| 4,973,524 | A | 11/1990 | Huebner et al. | |
| 5,139,886 | A | 8/1992 | Truong et al. | |
| 5,151,167 | A | 9/1992 | Turong et al. | |
| 5,472,796 | A | 12/1995 | Breedis et al. | |
| 6,383,657 | B1 | 5/2002 | Weber | |
| 6,432,556 | B1 | 8/2002 | Brauer et al. | |
| 6,656,606 | B1 | 12/2003 | Morin et al. | |
| 7,296,370 | B2 | 11/2007 | McDaniel et al. | |
| 2003/0168310 | A1* | 9/2003 | Strauts et al. | 194/302 |
| 2004/0173434 | A1* | 9/2004 | Morita et al. | 194/320 |
| 2005/0051409 | A1* | 3/2005 | Howells | 194/317 |
| 2006/0068219 | A1 | 3/2006 | McDaniel et al. | |
| 2006/0068234 | A1 | 3/2006 | McDaniel et al. | |

FOREIGN PATENT DOCUMENTS

| | | | |
|---|---|---|---|
| CA | 2214613 | | 9/1997 |
| CA | 2271654 | | 5/1998 |
| CA | 2013639 | | 6/1998 |
| CA | 2019568 | | 11/1998 |
| CL | 261-1991 | | 9/1991 |
| CL | 1664-1998 | | 2/1999 |
| CL | 1859-1998 | | 4/1999 |
| DE | 3207822 | | 9/1983 |
| EP | 0450883 | B1 | 10/1991 |
| EP | 0733316 | A2 | 9/1996 |
| GB | 2245283 | A | 3/1992 |
| GB | 2398161 | | 5/2006 |
| JP | 2004162083 | | 6/2004 |
| KR | 800000256 | | 4/1980 |
| KR | 10-0139222 | | 5/1998 |
| TW | 214306 | | 10/1993 |
| TW | 1250475 | | 3/2006 |
| TW | 200643829 | | 12/2006 |
| WO | WO96/18173 | | 6/1996 |

OTHER PUBLICATIONS

Charles Hellier: "Eddy current testing" In: "Handbook of nondestructive evaluation", Jan. 1, 2003, Mc Graw-Hill, XP055123404, pp. 8.1-8.39.*

Examination Report of companion Australian Application No. 2009202339 dated Aug. 26, 1990 (2 pages).

Compainion case Chilean Office Action related to Chilean application No. 1397-2009 dated Nov. 17, 2011 (6 pages).

Companion case Philipines Search Report for Philipine application 1-2009-000177 dated.

Companion case Korean Office Action for Korean application 10-2009-0052999.

Companion case Chilean Office Action releted to Chilean application No. 1397-2009 dated May 13, 2011(7 pages).

Jun. 15, 2011 Hamecker Carey summary of Companion case Chilean Office Action releted to Chilean application No. 1397-2009 dated May 13, 2011.

Information Disclosure statements (PTO/SB08) filed in parent U.S. Appl. No. 12/483,423, filed Jun. 12, 2009 and references cited by the Examiner (13 pages).

Notice for Decision for Patent regarding companion Korean application 10-2009-0052999 (3 pages).

"Multi-ply plating process makes steel-core coins," pp. 15-17, Advanced Materials & Processes, Mar. 1, 2008, XP055044404. In particular, p. 17 is important.

Extended European Search Report related to companion European Application 09007789.2.

Examination Report, issued by The Arab States of The Gulf (GCC) in Serial No. 13/44033.

Oliver, "Establishing technical specifications for New Zealand's new 10 cent, 20 cent and 50 cent coins", Reserve Bank of New Zealand: Bulletin, vol. 71, No. 2, Jun. 2008, pp. 57-63.

European Appln. No. 09 007 789.2-1359, Office Action dated Mar. 13, 2014, 6 pages.

Philippines Appln. No. 1/2009/000177, Substantive Examination Report dated May 28, 2014, 2 pages.

* cited by examiner

A) (Prior Art)

Oneway Anova

Means for Oneway Anova

| Level | Number | Mean | Std Error | Lower 95% | Upper 95% |
|---|---|---|---|---|---|
| 1) 60% Copper Layer | 1827 | 79.084 | 0.13141 | 78.83 | 79.34 |
| 3) Normal Copper Layer | 1689 | 98.258 | 0.13667 | 97.99 | 98.53 |
| 5) 140% Copper Layer | 1920 | 109.857 | 0.12819 | 109.61 | 110.11 |

Std Error uses a pooled estimate of error variance

CONTROL OF ELECTROMAGNETIC SIGNALS OF COINS THROUGH MULTI-PLY PLATING TECHNOLOGY

The present patent application is a divisional of U.S. patent application Ser. No. 12/483,423 filed on Jun. 12, 2009 now abandoned, which claims the priority of U.S. Patent Application No. 61/061,287 filed Jun. 13, 2008, which is hereby incorporated by reference.

FIELD OF THE INVENTION

The present invention relates to novel metallic composites that are suitable as coinage materials for the minting industry. More particularly, the present invention is directed to metallic composites designed for the specific purpose of affecting their electromagnetic properties, in particular their electromagnetic signature (EMS), and includes a method of making coins as well as the coins themselves.

BACKGROUND OF THE INVENTION

Coins are commonly used as a means of payment in vending or similar automatic machines. In this function, the coin needs to be recognized and identified by the machine and either accepted or rejected. This discrimination process is carried out by a device called a coin acceptor and generally consists of measuring various physical properties of the coin as it move's through the acceptor's mechanism.

Most coin acceptors presently in use rely on signals that result when a coin disturbs a variable electromagnetic field. For example, a coin moves between two coils acting as emitting and receiving antennae, respectively. The signal picked up by the receiving coil is then analyzed using a proprietary algorithm to produce what is called an electromagnetic signature (EMS) of the coin. Based on its EMS, the coin is either accepted or rejected.

A common problem affecting coin acceptors is the fact that electromagnetic signatures (EMSs) may be very similar for different coins. When the EMSs of coins of different denominations or coins issued in different jurisdictions are similar, there is an opportunity for fraud.

As referenced above, EMS values are not calculated by any physical, chemical or mathematical formula. Rather, they are a set of numbers generated by software and algorithms devised by each coin acceptor mechanism manufacturer. EMSs are unit-less and are made up of a set of figures which are purported to determine the diameter, the edge thickness, the weight, the alloy composition, etc., of a coin at different frequencies. Moreover, these values are not single repetitive values which identify the characteristics of the coin. Rather than being exact; the values vary from coin to coin within a certain range. Accordingly, that range is critical for coin acceptor manufacturers, since even perfectly valid coins may be rejected. The range of values must therefore be established so as to properly characterize the specific properties that identify the particular features of a coin, such as its diameter, edge thickness or alloy.

Perhaps one of the best ways to relate an EMS to a known physical measurement is through the metal's conductivity. Commercial instruments are available to measure conductivity, such as the Dr. Foerster's™ Sigma D conductivity meter and the Fischer Sigmascope® SMP10 conductivity meter.

With base metals increasing in price over the last 30 years, people working in the minting industry have come up with ideas on how to reduce the cost of producing coins, including finding metal substitutes for more expensive base metals, such as nickel and copper. Substitutes include mono-ply plated steel products. Mono-ply plated steel consists of plating a single layer of a metal or an alloy over steel. This is to be distinguished from multi-ply plated steel, which consists of plating several layers on steel.

Sample patent applications and patents that describe mono-ply plated steel include the following: Canadian Patent Application No. 2,137,096, Canadian Patent No. 2,271,654, U.S. Pat. No. 4,089,753, U.S. Pat. No. 4,247,374 and U.S. Pat. No. 4,279,968. Alternatives include coins in which the core is made of a metal, such as nickel or copper, which is mono-ply plated with either another metal or an alloy. Sample patents of this type include U.S. Pat. No. 3,753,669, U.S. Pat. No. 4,330,599 and U.S. Pat. No. 4,599,270.

Inconveniently, coin acceptor mechanisms in the vending industry often cannot differentiate between coins from different countries that are made of the same alloy and have approximately the same diameter, thickness and weight. In addition, mono-ply plated steel coins have EMSs that are so variable and so close to that of steel that many vending machines cannot be calibrated to differentiate between regular steel and mono-ply plated steel.

Metal disks, especially coins, have been produced so as to be distinguishable and separable from one another on the basis of their magnetic properties. As proposed by German Patent Application DE 3207822 and U.S. Pat. No. 3,634,890, laminate metallic claddings suitable for coin production include magnetizable metals (such as nickel) as well as non-magnetizable metals (such as a copper-nickel alloy containing 5 to 60 percent nickel). Along the same lines, U.S. Pat. No. 4,973,524 describes a method of making coins that are a suitable as an alternative to nickel-containing coins, the method comprising the steps of forming a laminated composite comprising a core layer of a first corrosion-resistant steel, such as ferritic-chromium steel, and cladding layers on opposite sides of this core layer with a second corrosion-resistant steel, such as austenitic nickel-chromium steel.

Despite the above, counterfeiters are actively finding ways to get past the electronic devices used in vending machines, and therefore fraud continues to be a major problem. There thus remains a need for novel coins that combine metals that are favored by manufacturers of legal tender but that may be discriminated on the basis of their EMSs.

The present invention seeks to meet this and related needs.

SUMMARY OF THE INVENTION

The shortcomings associated with current coin technology can result in a breach of security and revenue when vending machines cannot distinguish coins from two different countries, or when the vending machines cannot differentiate between a mono-plated steel coin and a steel slug. In order not to jeopardize the vending machine industry, many coin acceptors simply do not accept any mono-ply plated steel coins.

The present invention provides an alternative to coinage materials that are currently available. Specifically, the present invention relates to novel multi-ply metallic composites and their use in the manufacture of coins.

On the condition that one or more of the plated layers is/are non-magnetic if the core is steel or made of another magnetic material such as nickel, or on the condition that the plated layer is of a magnetic material if the core is non-magnetic, the intensity of the induced current can be modulated through the control of the thickness of the layers of the paired combination of magnetic and non-magnetic materials in such a way that the coin will generate totally different induced current features. This permits coin acceptor mechanisms to differentiate, recognize and identify coins as being different, even though they may have the same or a very similar diameter, thickness and weight. The ability to discriminate two coins having the same physical features even though they have different designs is a unique and very powerful tool to control the misuse of coins of one country in another country. Unlike human beings, coin acceptor mechanisms in their present technological state do not look at the visual or graphical features of coins to identify them. As indicated above, acceptor mechanisms work on current waveform data and defined feature points.

It has been found that by judiciously choosing the type of metals deposited through electrogalvanic (plating), and by manipulating the plating deposit thicknesses of the metal layers, the type of induced current generated by a coin can be modulated. If one or more of the plated layers are non-magnetic, and the core is made of a magnetic material such as steel or nickel, the intensity of the induced current can be modulated. Alternatively, if one or more layers are magnetic, and the core is made of a non-magnetic material, such as copper, zinc, tin, aluminum, silver, gold, indium, brass or bronze, the intensity of the induced current can also be modulated. Specifically, by controlling the thickness of the layers of the paired combination of magnetic and non-magnetic materials, the coin will generate completely different induced currents, which in turn allow coin acceptor mechanisms to distinguish coins even though they may have the same diameter, thickness and either an identical or similar weight.

Single layer plating, particularly with metals having magnetic properties, such as nickel and cobalt, was found to have inherent limitations that render manipulation of the EMS of a coin difficult, even by modifying such features as the coin's thickness.

With all of the above in mind, the present invention provides:

1) A multi-ply plating process that produces metallic composites which overcome the problem of being unable to differentiate between two coins comprising the same alloy and of the same size;
2) A multi-ply plating process that produces metallic composites which overcome the inability and the difficulty of calibrating vending, machines precisely and accurately in order to recognize a mono-ply steel plated coin, particularly when the plated material is magnetic such as nickel or cobalt.
3) A multi-ply plating process that prevents counterfeiting of coins made of plated materials because the order of the clad metal layers and the plating thicknesses of the layers can be defined and controlled in a reproducible manner in order for the coin to generate the same induced current, that is, the same EMS.
4) A multi-ply plating process that produces metallic composites whereby the core may be steel over which nickel and then a non-magnetic metal such as copper, or brass, or bronze can be deposited as a layered pair, and the EMS is controlled by defining the thickness of the deposited metal layers.

Alternatively, the magnetic and non-magnetic pair may be plated in the reverse order, that is, copper over steel followed by nickel. The key is in controlling the thicknesses of the layers of metals deposited.
5) A multi-ply plating process whereby (1) a magnetic metal such as nickel or cobalt is plated over a magnetic steel core, then (2) a non magnetic metal such as, but not limited to, copper, brass, bronze or zinc is deposited and (3) an external layer of nickel is plated in order to control the electro-magnetic signal of the metallic composite product. This is achieved through control of the thicknesses of the metals deposited. The external layer of nickel may be any other metal, either magnetic (such as chromium) or non-magnetic, for visual color effect and/or wear resistance.
6) A multi-ply plating process whereby a magnetic metal such as nickel or cobalt is deposited over a non-magnetic metal core, such as copper, brass or bronze, to form a paired magnetic and non-magnetic metal combination in order to control the EMS. This is achieved by controlling the thickness of the nickel or cobalt that is deposited.
7) A multi-ply plating process whereby (1) a magnetic metal, such as nickel, is deposited over a steel core, then (2) a non magnetic metal such as copper, zinc, brass, bronze is deposited, and (3) another layer of magnetic metal such as nickel is deposited. A final layer of silver or gold is deposited in order to control the electromagnetic signal of the composite product. This is achieved through control of the thicknesses of the metals deposited. The external layer of silver or gold is deposited to give a value-added appearance and to modify the conductivity or the color of the composite product combination (nickel—silver or nickel—gold), in addition to the first pair of magnetic—non magnetic combination (nickel-copper).

Other objects, advantages and features of the present invention will become apparent upon reading of the following non-restrictive description of embodiments thereof, given by way of example only with reference to the accompanying drawings.

DETAILED DESCRIPTION OF THE INVENTION

Figure 1:
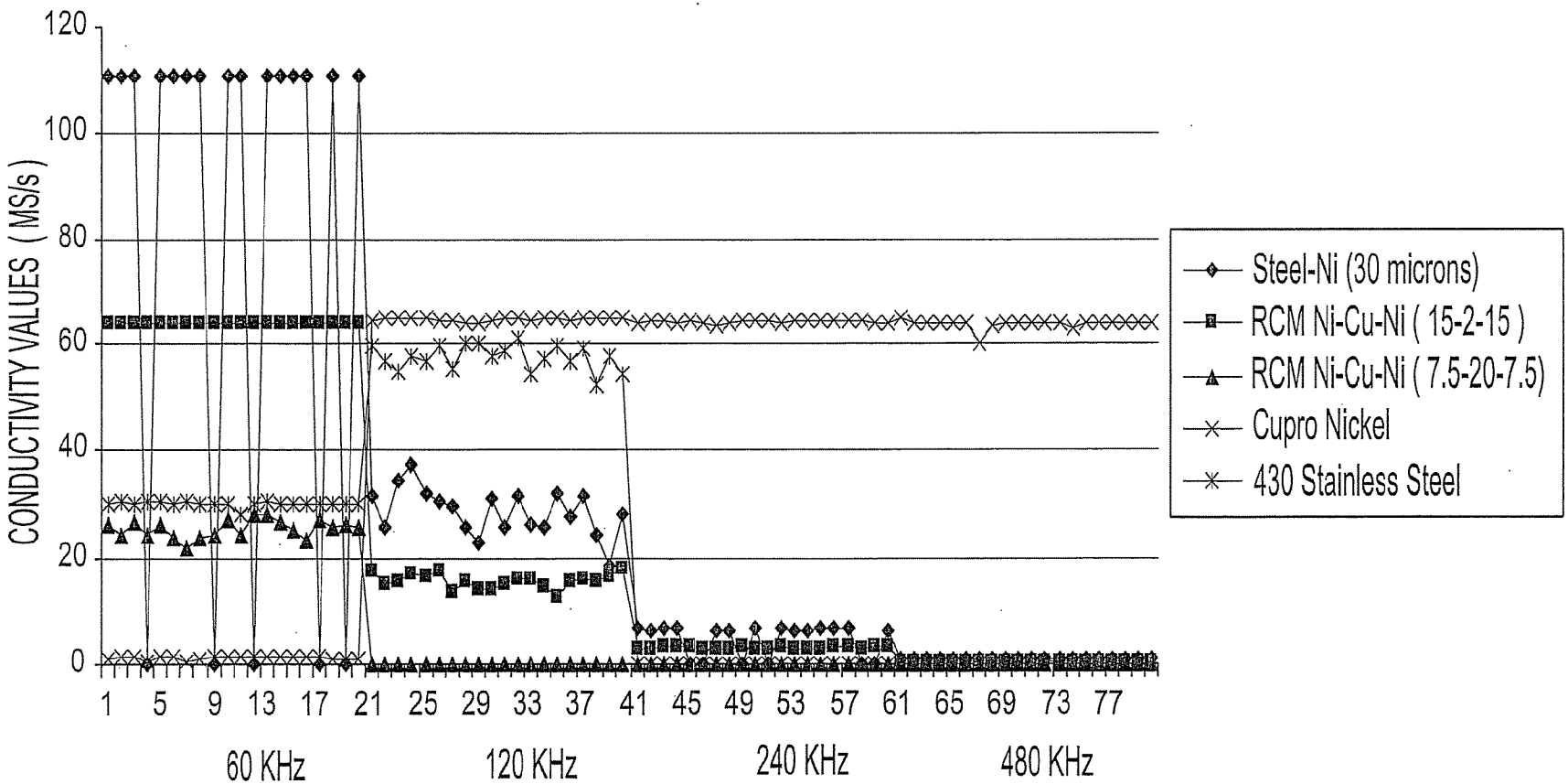
FIG. 1: Conductivity of different metallic composites.

All coin acceptors are designed to work on the induction principle. A coin acceptor is designed to have live coils (sensors) under power at 2 or 3 different frequencies (normally, 2 frequencies, high (240 KHz and higher) and low (60 KHz and lower)). The coils are sufficiently removed from each other so that no significant current is picked up by a current analyser connected to the live coils.

When a coin is dropped into a coin acceptor, the (space) gap between the coins is quickly and temporarily closed and a current is induced as the coin goes past the coils (sensors). The inductance of the sensors combined with the eddy current in the coin generates two (2) sinusoidal electric currents, due to two (2) different sets of coils at two (2) different frequencies.

The current analyser combines the 2 currents, which are then analysed at various points which are identified as EMS signals.

The captured EMSs are analysed with proprietary algorithms specific to each coin acceptor model and brand. The EMSs are converted to data identified as parameters.

The EMSs are dependent on the size (diameter), mass (edge thickness and weight) and type of metals (or alloys) used to make the coins.

Accordingly, coins of the same alloy and approximately of the same diameter cannot be differentiated by the coin acceptors. For example, the US five (5) cent coin and the Canadian five (5) cent coin (dated prior to 1999) are both made of cupronickel (75% copper 25% nickel) and cannot be differentiated by the existing coin acceptors in the market.

The shortcomings of today's coin recognition and discrimination technology can have serious consequences for the economy of a country. In the case of the US (5) cent and the Canadian (5) cent coins, the problem is accepted because their face values are approximately the same. For other countries, however, the economical ramifications can be very serious if their exchange rates are far apart, because if the coins of two countries are exactly or almost of the same diameter, size, thickness, weight and/or same alloy, they can be used interchangeably in vending machines. This opens the door to fraud and counterfeiting, because vending machine sensors do not rely on the pictorial or visual designs to recognize and to differentiate the coins.

The object of this invention is the creation of metallic composites that are suitable for coin production. The resulting coinage products are unique since they help to eliminate the problems associated with look-alike coins which have plagued many European, North American and Asian economies. Many nations have a broad base of automated merchandising services that rely in the use of coins, including automatic candy machines, sandwich machines, telephones, soft drink dispensers, coffee machines, public or common transit services, parking meters, road tolls, casinos and gaming machines. The novel coins of the present invention should be useful for such services.

Since coin acceptors have different means and ways of capturing and recording the EMSs, the best way to illustrate and to explain the concept is to relate the metallic characteristics to its current conductivity measured in IACS % (international annealed copper standard percentage).

FIG. 1 shows the typical conductivity of different alloys at different frequencies. The coin identification number (coin number 1 to coin number 80) appears on the X axis and conductivity of the metal measured in IACS % appears on the Y axis. The measurements were done using a Dr. Foerster's™ conductivity meter at different frequencies.

FIG. 1 shows that each metal product, for example, cupronickel or stainless steel, has its own conductivity at a fixed frequency. The product identified as RCM (for Royal Canadian Mint) Ni—Cu—Ni (5-15-5) is a product consisting of a low carbon steel core (SAE 1006) plated with a layer of nickel of 5 microns, then a layer of copper of 15 microns, then a final nickel layer of 5 microns.

Figure 2:
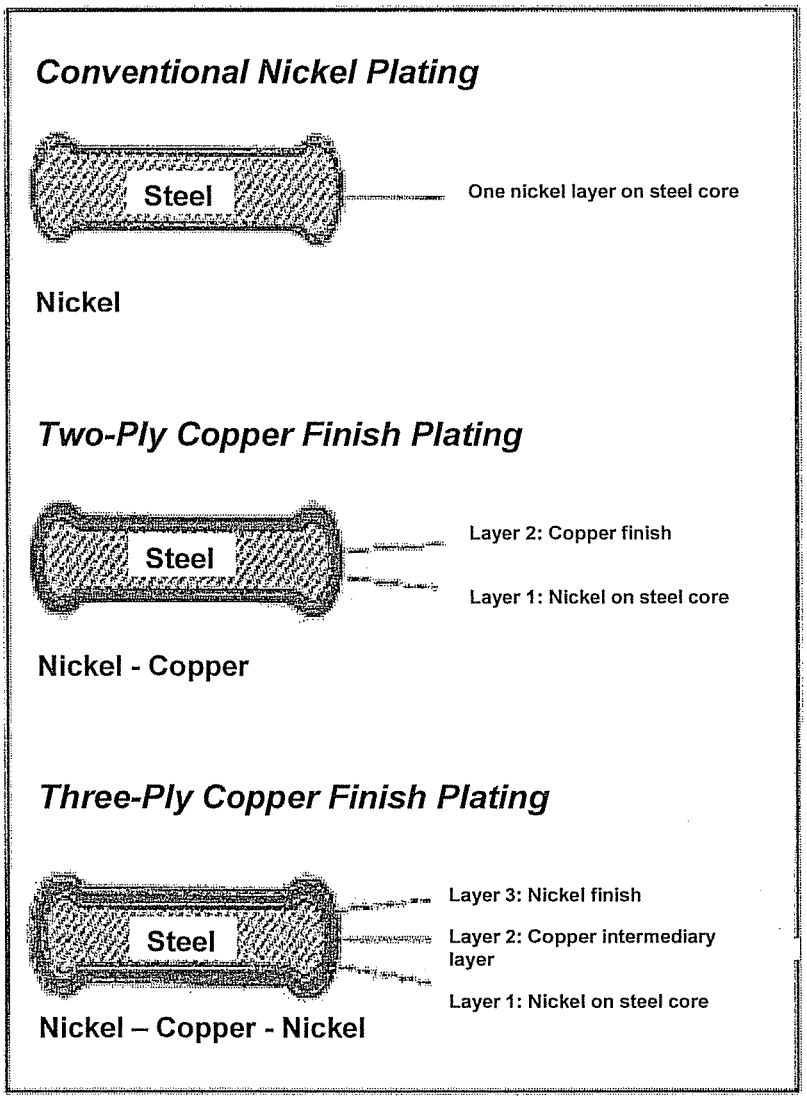
FIG. 2: Plating Processes (A) Single ply technology has one coating of metal over a steel blank, such as nickel over steel for white coins, copper over steel for red coins and bronze or brass over steel for yellow coins; (B) The Royal Canadian Mint (RCM) multi-ply technology utilizes more than one layer of coating, for example, in the case of red and yellow coins, nickel over steel followed by copper, bronze or brass, depending on the colour chosen for the coin; and (C) In one embodiment, the RCM multi-ply technology utilizes three layers for the production white coins, wherein the first layer is nickel, the second layer is copper and the third layer is nickel plated over the copper, creating a sandwich of layers.

The difference between single layer blanks and RCM Multi-layer Blanks is shown in FIG. 2. U.S. Pat. No. 5,139,886 and U.S. Pat. No. 5,151,167, describe an electroplating process that is suitable for the purposes of the present invention. All of these patents are hereby incorporated by reference.

Returning now to FIG. 1, the RCM Multi-ply blanks (7.5-20-7.5) show that they have a small range of conductivity values, at the 60 KHz frequency, between 20 and 28 IACS %. It will be recalled that the X axis represents a sample coin number. Each coin number has a IACS % value at a frequency. For example, coin 4 has a value of 24 IACS % and coin 7 has a value of 22 IACS %. The small variation is due to the fact that it is very difficult to control the exact thickness of plated nickel deposit and of copper deposit because the deposit is done through electro-galvanic plating, a process that is known to those of skill in the art. The plating deposit may vary somewhat from coin to coin.

FIG. 1 also shows that the product RCM Ni—Cu—Ni (15-2-15) has a different range of conductivity. It was plated with 15 microns nickel, 2 microns copper, 15 microns of nickel.

Figure 3:
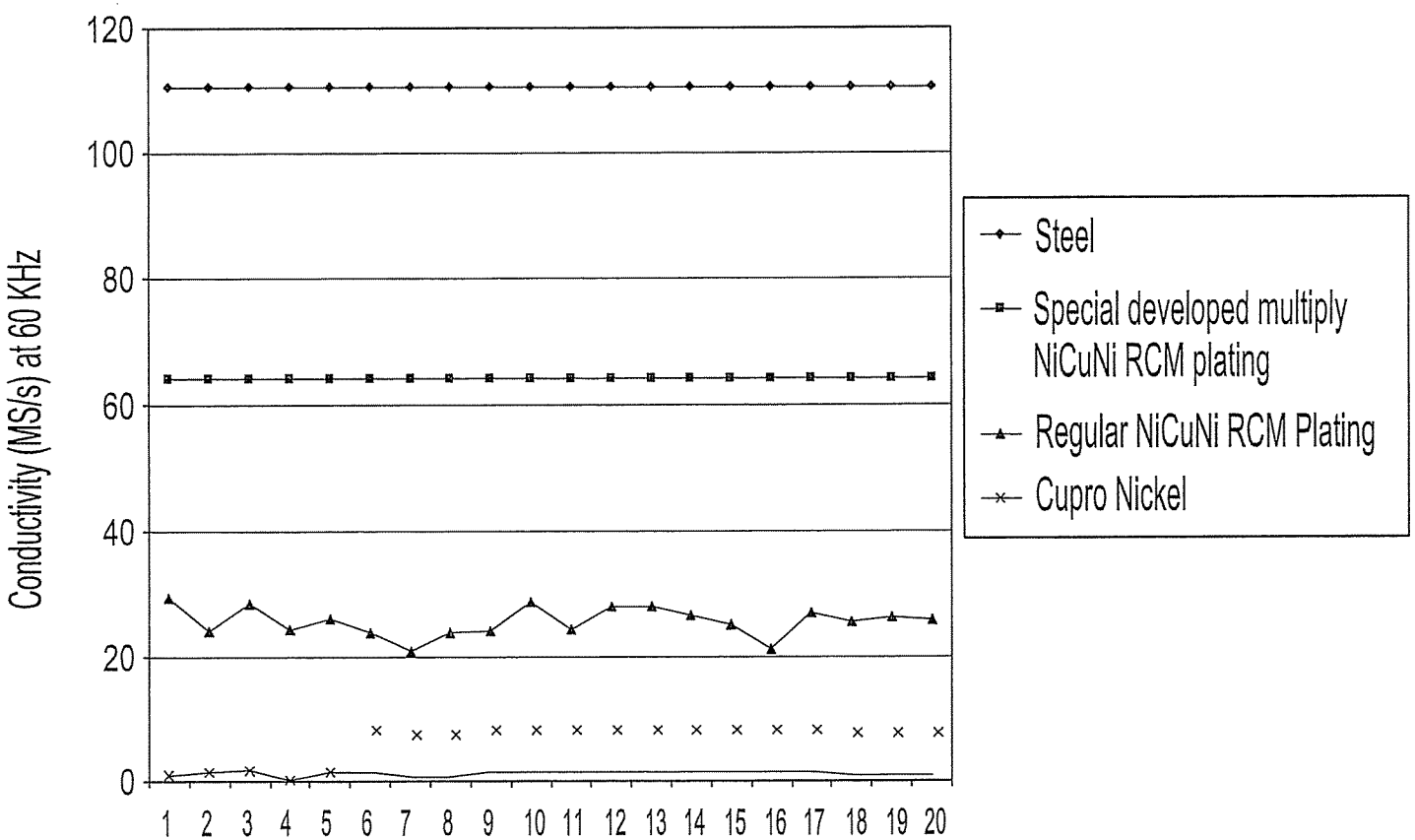
FIG. 3: EMSs of different metallic composites at 60 KHz.

FIG. 3 shows the EMS of steel, of special multi-ply Ni—Cu—Ni RCM plating and of cupronickel at 60 KHz.

In comparison, the EMS of a mono-layer of nickel on steel at 60 KHz gravitates around 110% IACS, which is the approximate EMS of steel. The range of values reflects the strong magnetic nature of steel and nickel. Practically speaking, the variations associated with mono-layer products are too numerous to be considered usable by vending machine manufacturers to calibrate coin acceptors. In addition, steel cannot be considered as a coinage material for the following reasons: it rusts, it is a very common material and if a coin is made of steel only, it may be readily counterfeited by anyone equipped to cut a steel disc of the correct size.

As indicated above, steel and nickel are magnetic, and nickel plated steel is also magnetic. In order to make a metal alloy less magnetic and in order to give it a more stable EMS signal so that it can be used in the ranges devised by vending machine manufacturers for calibration, one has to stabilize the EMS value within a narrow range desired by the vending industry.

A plated material that can substantially affect the electrical current conductivity of a coin and that can be changed by modifying the thickness of material provides means for controlling and varying the conductivity, and therefore, the EMSs of coins. Furthermore, if a metal can negate the effects of magnetism, the levels of magnetism can be varied and therefore EMS values can be modulated.

Pure copper is very conductive, offers very low resistance to electrical current flow and is non magnetic. Other metals or alloys which can be considered for the production of coins are, without limitation, aluminum, zinc, tin, silver, gold, indium, brass and bronze.

When a non-magnetic metal is plated over steel, the overall magnetic value of the paired "non-magnetic metal—steel" combination can be altered. This is an important consideration for the modulation of the magnetic intensity of a metallic composite, allowing flexibility in changing the EMS values of the metals formed. Moreover, by varying the thickness of the deposit of the non-magnetic metal layer over steel, various degrees of magnetism can be imparted to the combined non-magnetic—steel pair. These significant discoveries can serve as a powerful tool in the control of the EMS values of coins and hence, in the prevention of fraud.

In addition, the degree of electrical conductivity can significantly influence the intensity of the electrical current going through the non-magnetic-steel pair. In other words, the EMS of coins can be controlled through the judicious selection of the thickness of the metals or alloys, or combination of metals or alloys, deposited on steel. For example, by combining metals such as copper, nickel and steel, the magnetic properties and electrical conductivity of these metals can be advantageously combined to change the EMS of the resulting coins in order to give to each type of coin a range of specific values which can be used by coin acceptors to recognize, differentiate, discriminate and ultimately, to either accept or reject the coins.

EXAMPLE 1

To illustrate the control that can be exerted on the electromagnetic signals of coins of the present invention, a series of plating experiments were conducted. Different thicknesses of deposits of nickel and copper, in alternate layers, on steel blanks were made. The conductivity of the combined effect of the layers of nickel and copper at different frequencies was measured, and different results were obtained, as anticipated.

Figure 4:
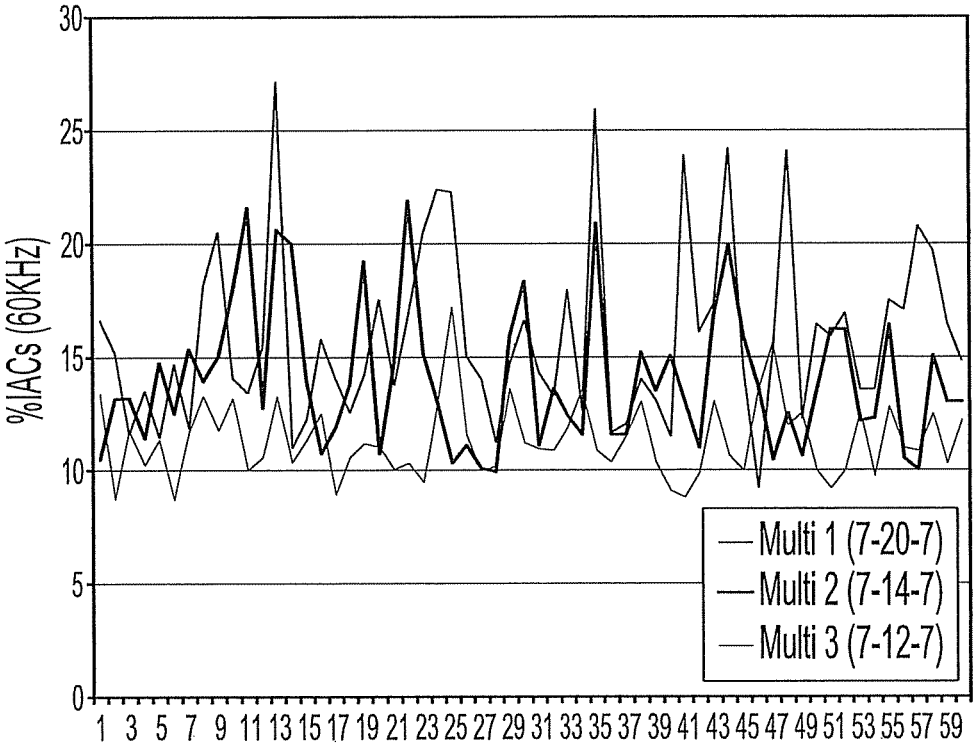
FIG. 4: Copper layer and EMSs of Plated Blanks.

FIG. 4 illustrates the difference in the electro-magnetic properties of metals by combining layers of nickel and copper. Specifically, this graph shows the resistivity of the multi-layered plated blanks as the level of copper content was varied while the nickel layers were held constant. The X axis shows the coin blank number while the Y axis shows the resistivity of the coins measured at 60 KHz with a Dr. Foerster conductivity meter.

Each layer exerts a certain influence on the EMS of the coins. Different metals have different influences. Tests have shown that changes in the thickness of the copper layer appear to affect the EMS the most.

The trend of the electrical conductivity change is very clear from FIG. 4. Multi 2 (7-14-7) with 14 microns of copper has, on average, a lower resistivity than Multi 3 (7-12-7) with 12 microns of copper. Multi 1 (7-20-7) has the lowest average resistivity with 20 microns of copper.

EXAMPLE 2

Figure 5:
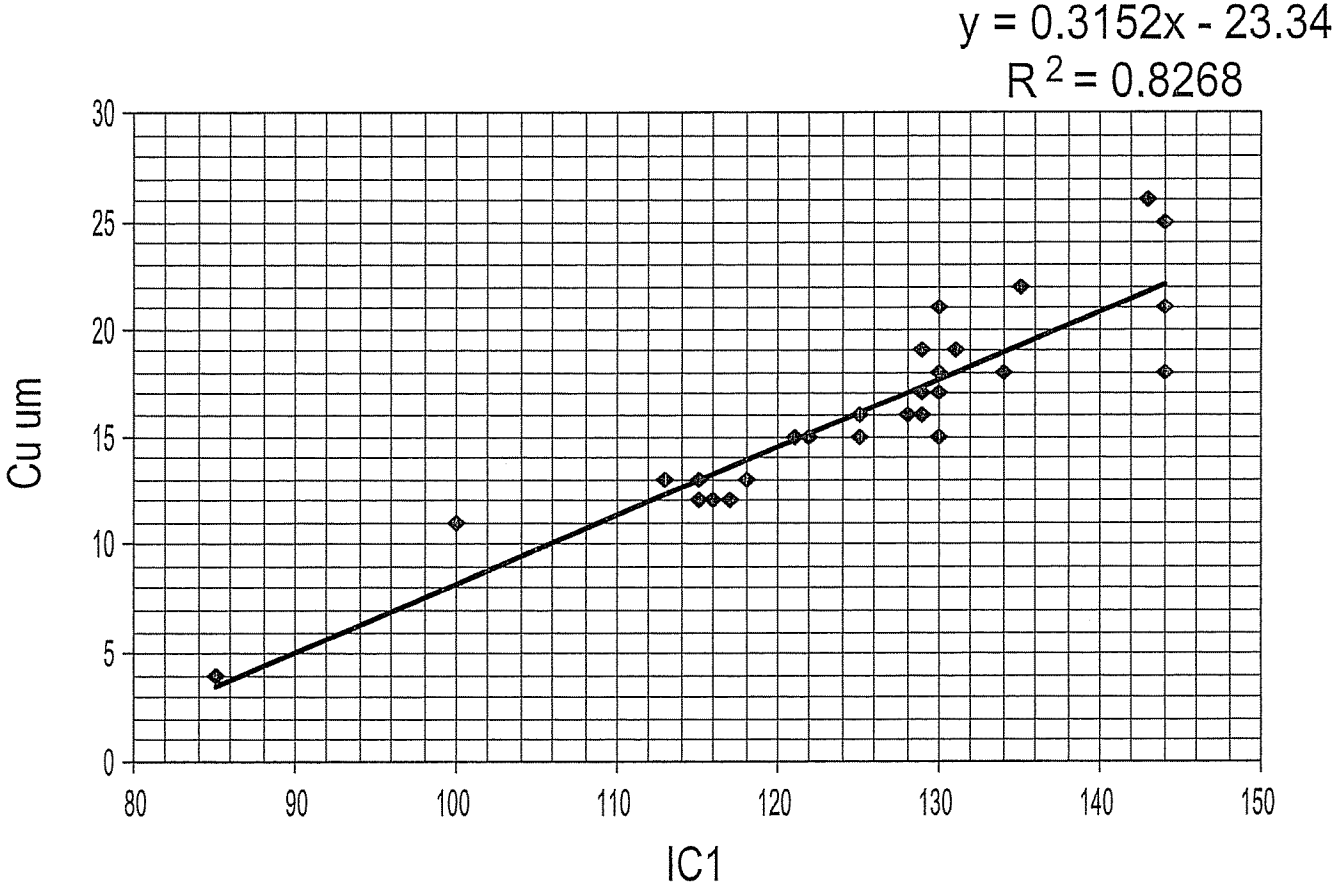
FIG. 5: Correlation between copper thickness and the Internal Conductivity 1 (IC1).

In another set of experiments, the EMS values of a large number of coins were recorded. These coins, which were plated by a multi-ply plating process such as that described in Canadian Patent No. 2,019,568 (Truong et al.), were allowed to pass through a commercial coin sorter, Scan Coin 4000 (FIG. 5). The recorded values, identified as IC1 (internal conductivity at coil 1) were plotted against the thickness of copper found by cross-sectioning the coins, mounting the coins for metallographical observation and measuring optically the thickness of the different layers of copper and nickel in the coins.

The internal nickel layer is fairly constant at 6 microns and the external nickel layer is approximately between 10 and 11.5 microns. The copper layer varies between 4 to 24 microns.

FIG. 5 shows a direct correlation between the thickness of copper and the IC1 values recorded by the Scan Coin sorter.

EXAMPLE 3

In another series of experiments, three (3) different types of blanks were plated with the following arrangements of plating thickness conditions:

Thickness of Plating

| Blank Type | Inside Nickel Layer | Copper Layer | Outside Nickel Layer |
|---|---|---|---|
| Sample 1 (red plot | 7μ | 12μ | 5μ |
| Sample 2 (green plot) | 7μ | 19μ | 5μ |
| Sample 3 (blue plot) | 7μ | 26μ | 5μ |

The blanks were minted into coins and the coins were passed through the commercial ScanCoin coin sorter, model 4000, which measures the coin conductivity.

Figure 6:
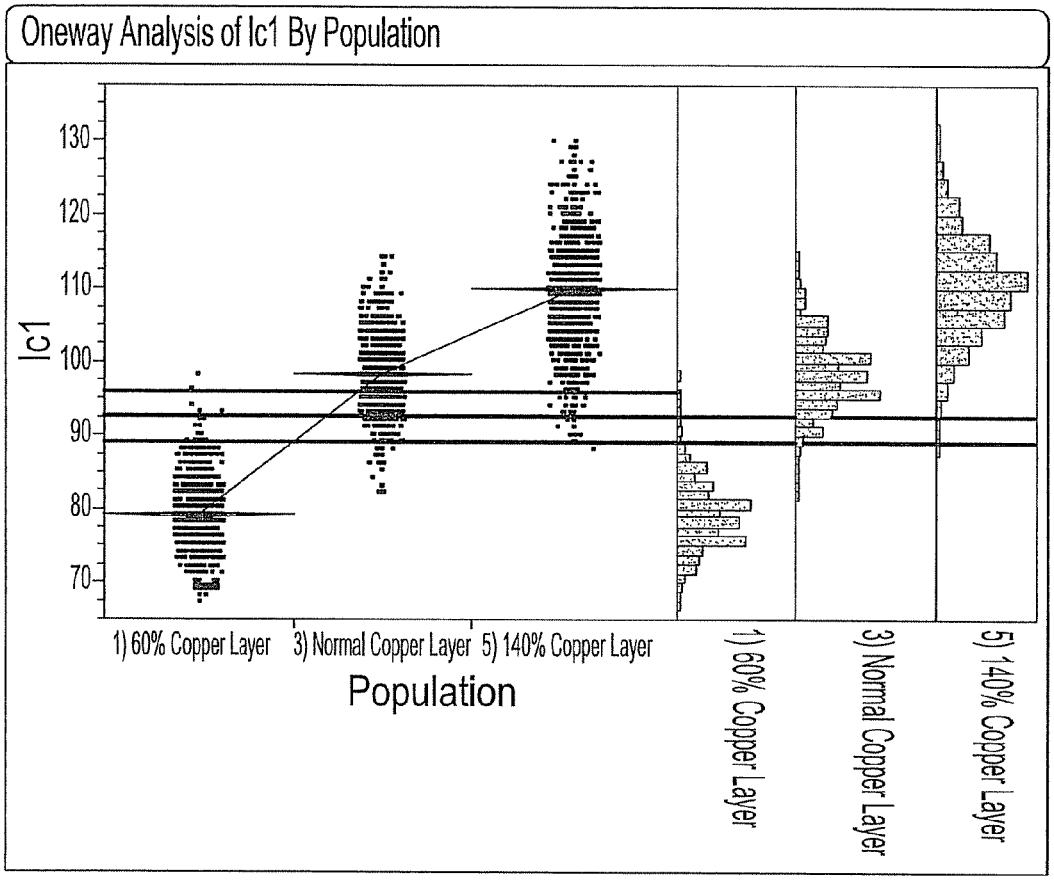
FIG. 6: Conductivity analyses of IC1 by population.

FIG. 6 shows the conductivity analysis by population on the X axis while the coin Y axis shows the conductivity values for all 3 samples. The 3 representations (at the right hand corner of FIG. 6) are typical bell curve distributions of the same data for the 3 types of blanks. Once again, it may be seen that as the thickness of the copper layer is changed, the conductivity of the coins also changes, and these differences allow the coin reader of the ScanCoin coin sorter to differentiate, to recognize and to sort the coins.

It should be noted that, for all practical purposes, the differences in the weights of the 3 coins are not perceptible because a difference of a few microns of copper is of the order of 0.005 g to 0.01 g.

This invention thus provides a very powerful tool to change the EMS of coins. It is quite unique since the process makes it possible to alter the electrical conductivity of metallic coins which is not possible with conventional metallurgical alloys.

The practical uses of this invention are enormous since this method provides means to alter the physical and electrical properties of coins without having to substantially change alloy compositions. The process is unique, very economical and provides an excellent method to create different electromagnetic signals for coin differentiation which is not possible by other means.

Each alloy has its own EMS. A small change in alloy composition over 1 percent does not change the EMS of the alloy. In multi-ply electroplating, it is possible to change the EMS of the metal product significantly by making a judicious change of the order of a few microns in the copper layer deposit which represents a change of less than 0.005 percent of the weight of the coin.

This concept applies to a deposit of 2 or more layers of metals, at least one of which is non magnetic, such as copper, zinc, tin, aluminum, silver, gold, indium, brass or bronze.

The above-described embodiments of the invention are intended to be examples only. Variations, alterations and modifications can be made to the particular embodiments described herein by those of skill in the art without departing from the scope of the invention, as defined in the appended claims.

What is claimed is:

1. A method of producing circulation coins having different electromagnetic signatures (EMS) and having approximately identical mass and exterior dimensions, the method comprising:

selecting first and second steel cores having approximately identical mass and exterior dimensions;

electroplating a first layer of nickel on the first steel core;

electroplating a first layer of copper over the first layer of nickel on the first steel core, the first layer of copper having a thickness of at least 4 μm, to produce a first coin having a first EMS defined by a first range of conductivity values;

electroplating a second layer of nickel on the second steel core;

electroplating a second layer of copper over the second layer of nickel on the second steel core, the second layer of copper having a thickness of at most 24 μm, to produce a second coin having a second EMS defined by a second range of conductivity values that is distinct or non-overlapping with the first range of conductivity values, each of the first and second ranges comprising plus or minus 17% difference of International Annealed Copper Standard (IACS), and the second coin having a mass that is at most 0.01 grams more than the first coin.

2. The method of claim 1, wherein the first EMS is a known EMS of a circulation coin and the second EMS is a unique EMS not used in any circulation coin.

3. The method of claim 1, wherein the second EMS is a known EMS of a circulation coin and the first EMS is a unique EMS not used in any circulation coin.

4. The method of claim 2, wherein the thickness of the second layer of copper is 12-20 μm.

5. The method of claim 3, wherein the thickness of the first layer of copper is 12-20 μm.

6. The method of claim 1, further comprising electroplating a third layer of nickel over the first layer of copper on the first steel core and electroplating a fourth layer of nickel over the second layer of copper on the second steel core.

7. The method of claim 1, wherein the electroplating is galvanic electroplating.

8. A method of producing a unique circulation coin having a different electromagnetic signature (EMS) from a known circulation coin, the method comprising:

selecting a steel core for the unique circulation coin, the steel core of the unique circulation coin having approximately identical mass and exterior dimensions as a steel core of the known circulation coin;

electroplating a first layer of nickel on the steel core of the unique circulation coin; and electroplating a layer of copper over the first layer of nickel on the steel core of the unique circulation coin, the layer of copper on the unique circulation coin having a thickness that is less than 20 μm different from a layer of copper on the known circulation coin, wherein the less than 20 μm difference in thickness of the layers of copper provides the unique circulation coin an EMS comprising a range of conductivity values that is distinct or non-overlapping with the range of conductivity values of the known circulation coin, wherein the range of conductivity values of the unique circulation coin comprises plus or minus 17% difference of International Annealed Copper Standard (IACS), and the less than 20 μm difference in thickness of the layers of copper provides the unique circulation coin with a mass that is at most 0.01 grams different from a mass of the known circulation coin.

9. The method of claim 8, wherein the thickness of the layer of copper of the unique circulation coin is 12-20 μm.

10. The method of claim 8, further comprising electroplating a second layer of nickel over the layer of copper on the unique circulation coin.

11. The method of claim 8, wherein the electroplating is galvanic electroplating.

* * * * *